US006227529B1

(12) United States Patent
Yoneoka et al.

(10) Patent No.: US 6,227,529 B1
(45) Date of Patent: May 8, 2001

(54) SHEET DISTRIBUTION DEVICE

(75) Inventors: Hideharu Yoneoka, Ibaraki-ken; Kenichirou Nakazawa, Nirasaki, both of (JP)

(73) Assignees: Nisca Kabushiki Kaisha, Yamanashi-ken (JP); Riso Kagaku Corporation, Tokyo (JP)

( * ) Notice: Subject to any disclaimer, the term of this patent is extended or adjusted under 35 U.S.C. 154(b) by 27 days.

(21) Appl. No.: 09/612,997

(22) Filed: Jul. 10, 2000

Related U.S. Application Data

(63) Continuation of application No. 09/036,030, filed on Mar. 6, 1998, now abandoned.

(30) Foreign Application Priority Data

Mar. 12, 1997 (JP) ..... 9-078860

(51) Int. Cl.[7] ..... B65H 39/00

(52) U.S. Cl. ..... 270/58.08; 270/58.11; 270/58.13; 270/58.14; 270/58.16

(58) Field of Search ..... 270/58.07, 58.09, 270/58.08, 58.1, 58.11, 58.12, 58.13, 58.14, 58.16

(56) References Cited

U.S. PATENT DOCUMENTS 4,925,172 * 5/1990 Christy et al. ..... 270/58.12
5,806,850 * 9/1998 Yoneoka et al. ..... 270/58.18 X
5,918,871 * 7/1999 Saito et al. ..... 270/58.08 X
5,924,689 * 7/1999 Fukai et al. ..... 270/58.08 X

FOREIGN PATENT DOCUMENTS

0807537A2 * 11/1997 (EP) .

* cited by examiner

*Primary Examiner*—Christopher P. Ellis
*Assistant Examiner*—Patrick Mackey
(74) *Attorney, Agent, or Firm*—Pitney, Hardin, Kipp & Szuch LLP

(57) ABSTRACT

There is disclosed a sheet distribution device in which when sheets are discharged to each distribution bin by a sheet moving means, reduced is a period of time required for shifting to the next sheet moving operation after one sheet moving operation is finished. The sheet distribution device receives image formed sheets 2 from an image forming device 1 and distributes and stores the sheets 2 into plural distribution bins 4. The sheet distribution device is provided with a post-processing means for post-processing the sheets 2 stored in the distribution bin 4, a sheet bunch pushing member 50 for moving the sheets 2 stored in the distribution bin 4 along the guide hole 28 in the distribution bin 4 to the post-processing means, and a guide rail 41 for elevating or lowering the sheet bunch pushing member 50. When the sheet bunch pushing member 50 is moved along the guide rail 41, the sheet bunch pushing member 50 can be moved in a direction in which the engagement with the guide hole 28 is released.

5 Claims, 12 Drawing Sheets

(A)

(B)

SHEET DISTRIBUTION DEVICE

This application is a continuation of Ser. No. 09/036,030 Mar. 6, 1998, now abandoned.

BACKGROUND OF THE INVENTION

1. Field of the Invention

The present invention relates to an improvement of a sheet distribution device which distributes and stores sheets discharged from an image forming device and performs a predetermined post-processing.

2. Description of the Related Art

As a sheet distribution device usually called "sorter", as disclosed, for example, in the Japanese Patent Application Laid-open No. Hei 4-43089, there is a known constitution in which a sheet with an image formed thereon (hereinafter, referred to as the printed sheet) discharged from a printer, a copying machine or another image forming device is successively distributed and accumulated by a sheet distribution means called "indexer" onto plural distribution bins (sorting trays). When the number of printed sheets accumulated on each distribution bin reaches a predetermined number, the bunch of sheets are bundled and stapled by using a stapler which can move vertically or horizontally (in a transverse direction of the sheet) along sheet receiving ends of plural distribution bins.

In the stapling process in which the stapler is used, the bunch of sheets on one of the distribution bins need to be selectively pushed out toward the stapler. For this purpose, in the conventional constitution, each distribution bin is constituted movable toward the stapler. Then, the distribution bin with the bunch of sheets to be stapled accumulated thereon are pushed out toward the stapler together with the bunch of sheets. Alternatively, each distribution bin is provided with a sheet bunch pushing member.

However, in the constitution in which the distribution bin can be moved toward the stapler, due consideration has to be given in order to avoid an interference of the distribution bin and the stapler. Not only in the constitution but also in the constitution in which each distribution bin is provided with the sheet bunch pushing member, a structure and drive system of the sheet distribution device are disadvantageously complicated.

To solve the problem, the applicant has proposed in the Japanese Patent Application Laid-open No. Hei 8-117514 a sheet bunch pushing device in which on a guide rail extended vertically through plural distribution bins provided is a sheet bunch pushing member for selectively pushing out toward a post-processing device a bunch of sheets on a predetermined distribution bin among the plural distribution bins. The sheet bunch pushing member is provided movable vertically along the guide rail.

In the proposed sheet bunch pushing device, the guide rail is provided in an opening which is formed in the distribution bin. The guide rail can be moved horizontally in the opening while keeping its perpendicularly raised condition. The sheet bunch pushing member is controlled to vertically move along the guide rail, while the guide rail itself is controlled to move horizontally together with the sheet bunch pushing member. Thereby, the bunch of sheets are selectively pushed out from one distribution bin to the post-processing device.

In the sheet bunch pushing device, when a movement locus of the sheet bunch pushing member is seen perpendicularly from the above, in a position in which the sheet bunch pushing member is farthest from the post-processing device (elevated or lowered vertically), the sheet bunch pushing member fails to overlap edges of the opening in the distribution bin. However, in a position (range) in which the sheet bunch pushing member pushes out the bunch of sheets, the sheet bunch pushing member overlaps one edge of the opening in the distribution bin. When the bunch of sheets on the distribution bin are pushed out by the sheet bunch pushing member, the distribution bin may be deflected or the sheets on the distribution bin may be deformed. Even in this case, by contacting all the sheets on the distribution bin in an engagement portion of the edge of the distribution bin and the sheet bunch pushing member (in the portion in which the edge and the sheet bunch pushing member slide against each other), the sheet bunch pushing member can securely push out all the sheets toward the post-processing device. In the portion where the edge of the distribution bin is engaged with the sheet bunch pushing member, at least a lower face (lower portion) of the sheet bunch pushing member is engaged with an upper face (upper portion) of the edge of the distribution bin. Alternatively, an upper face (upper portion) of the sheet bunch pushing member may abut on a lower face (lower portion) of the distribution bin just above the distribution bin from which the sheets are pushed out.

In the sheet bunch pushing device, when the sheet bunch pushing member is moved from one distribution bin to the next distribution bin, the sheet bunch pushing member is first retreated horizontally to a position where it is apart from the edge of the distribution bin. Subsequently, the sheet bunch pushing member is moved vertically along the guide rail. Further, the sheet bunch pushing member is moved horizontally to push out a bunch of sheets on the next distribution bin. Therefore, a horizontal movement distance of the sheet bunch pushing member is long. A period of time required for successively pushing out bunches of sheets accumulated on multiple distribution bins to the post-processing device is entirely prolonged. Consequently, there has been a demand for a reduction in time.

SUMMARY OF THE INVENTION

Wherefore, an object of the present invention is to provide a sheet distribution device which can reduce a period of time necessary for pushing out a bunch of sheets.

To attain this and other objects, the present invention provides a sheet distribution device which is provided with plural distribution bins into which sheets discharged from an image forming device are distributed and stored, a post-processing means for post-processing the sheets stored in each distribution bin, and a sheet pushing member elevatably provided along the plural distribution bins and operated to advance or retreat along each distribution bin and push out toward the post-processing device the sheets stored in each distribution bin. Each distribution bin is provided with a guide portion which allows the sheet pushing member to advance or retreat along each distribution bin. The sheet pushing member has an engaging portion which abuts on the guide portion of the distribution bin. The engaging portion of the sheet pushing member can be moved to a direction in which the engagement with the guide portion of the distribution bin is released.

Also, the engaging portion of the sheet pushing member is provided rotatable about an axial line parallel with a sheet pushing direction. Additionally, the engaging portion is constituted of a member biased in a direction in which the member abuts on an upper portion of the guide portion of the distribution bin.

Further, the guide portion of the distribution bin is formed in a strip in a middle portion of the distribution bin. There are two engaging portions of the sheet pushing member which are opposed to each other on opposite edges of the guide portion.

Further, in the sheet distribution device according to the invention, the post-processing means is a stapler or a punching device.

DETAILED DESCRIPTION OF THE PREFERRED EMBODIMENTS

Figure 1:
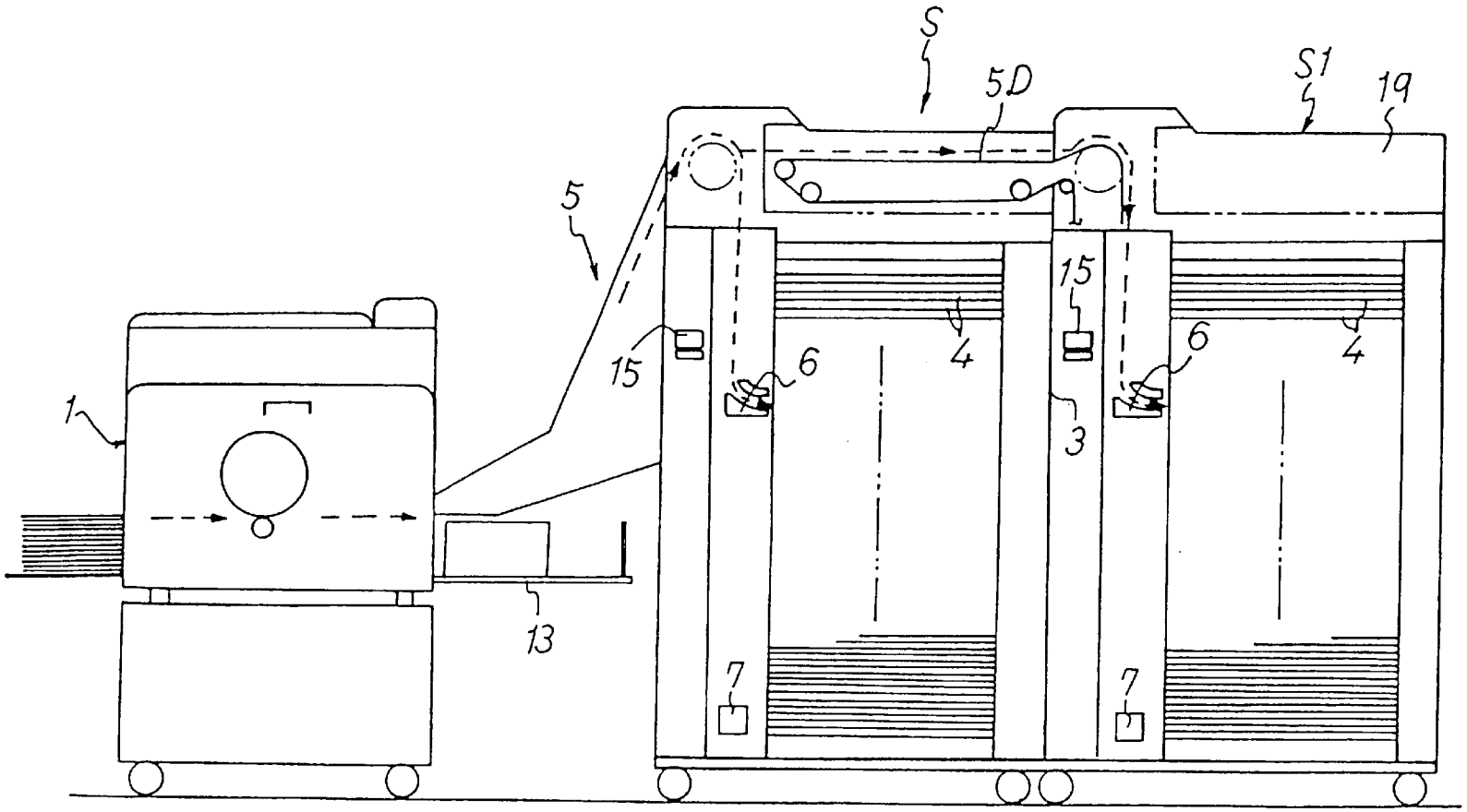
FIG. 1 is a diagrammatic side view showing that an embodiment of a sheet distribution device according to the invention is connected to an image forming device.
Figure 2:
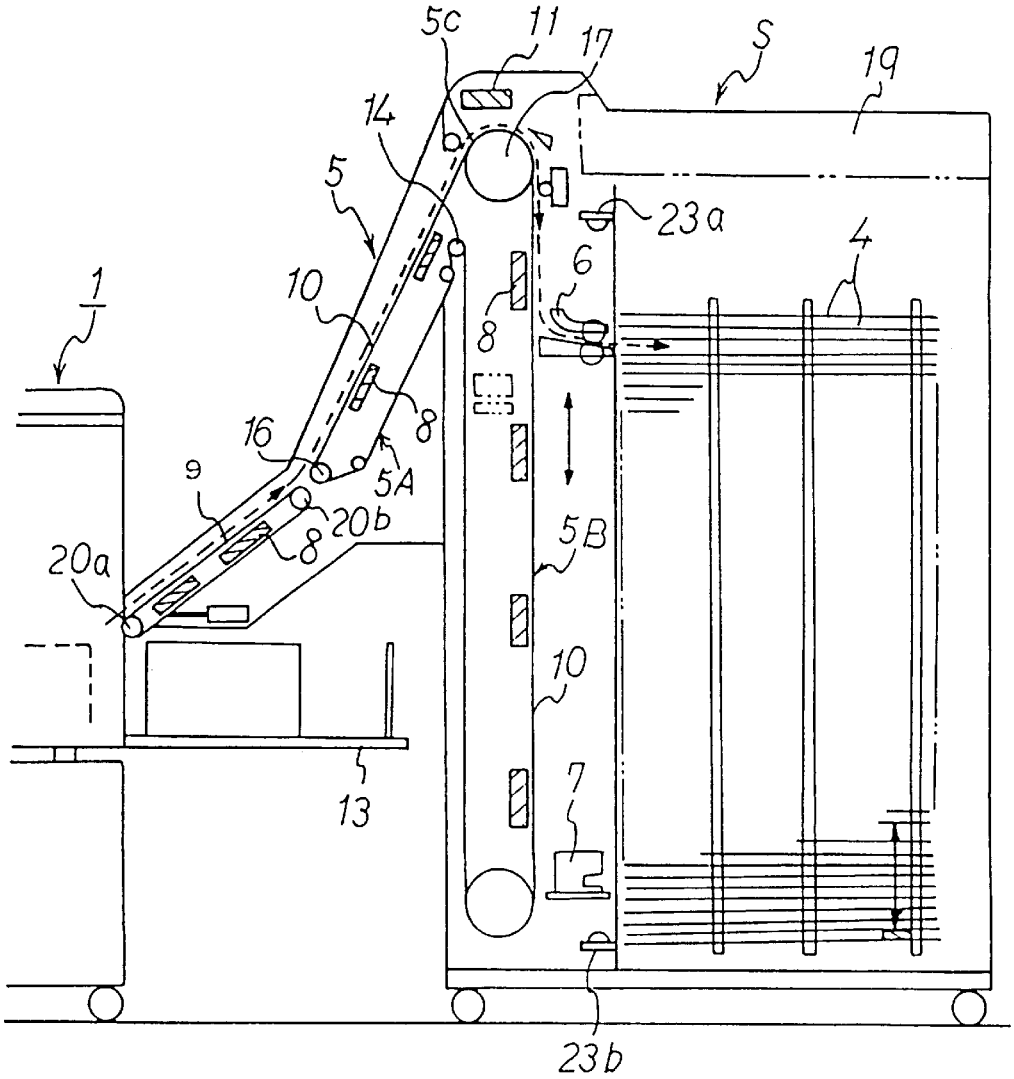
FIG. 2 is a diagrammatic side view showing an inner structure of the sheet distribution device of FIG. 1 in a perspective manner.

Embodiments of a sheet distribution device according to the invention will be described with reference to the accompanying drawings. FIGS. 1 and 2 show an entire constitution of the sheet distribution device: FIG. 1 is a diagrammatic side view showing a constitution in which the sheet distribution device is connected to an image forming device; and FIG. 2 is a diagrammatic side view showing an inner structure of the sheet distribution device of FIG. 1 in a perspective manner.

A sheet distribution device S is provided with plural distribution bins 4 constituted of plural, e.g., fifty trays vertically arranged with predetermined intervals kept thereamong in a fixed position in a frame 3 for successively receiving an image formed or printed sheet 2 (FIG. 3) from a printer or another image forming device 1 to accumulate a predetermined number of sheets; a conveying means 5 for conveying the printed sheet 2 from the image forming device 1 toward the distribution bins 4; an indexer 6 provided movable vertically along a sheet receiving end of the plural distribution bins 4 for changing a direction of the sheet 2 conveyed by the conveying means 5 with a curved top-face guide portion to feed and distribute the sheet 2 to each distribution bin 4; and a stapler 7 being movable vertically and horizontally along the sheet receiving end of the distribution bin 4 to staple and bundle a bunch of sheets.

When the image forming device 1 is a printer, especially, a stencil printer, a large number of sheets can be printed in a short time. The sheet 2 with a wet ink loaded thereon is discharged at a high speed. In the conveying means 5 for conveying the sheet 2 from the image forming device 1 to the indexer 6, during conveying, a rear face of the sheet 2 is drawn and held to be kept away from a surface of another sheet.

As shown in FIG. 2, the conveying means 5 is constituted of a first conveying portion 5A for conveying the sheet 2 discharged from a discharge portion of the image forming device 1 obliquely upward to an upper portion of a body, a second conveying portion 5B for conveying the sheet 2 from the upper portion downward to the indexer 6, and a curved portion 5C provided on an upper end of the second conveying portion 5B for receiving the sheet 2 from the first conveying portion 5A and curving the sheet 2 in a conveying direction at an acute angle.

Figure 3:
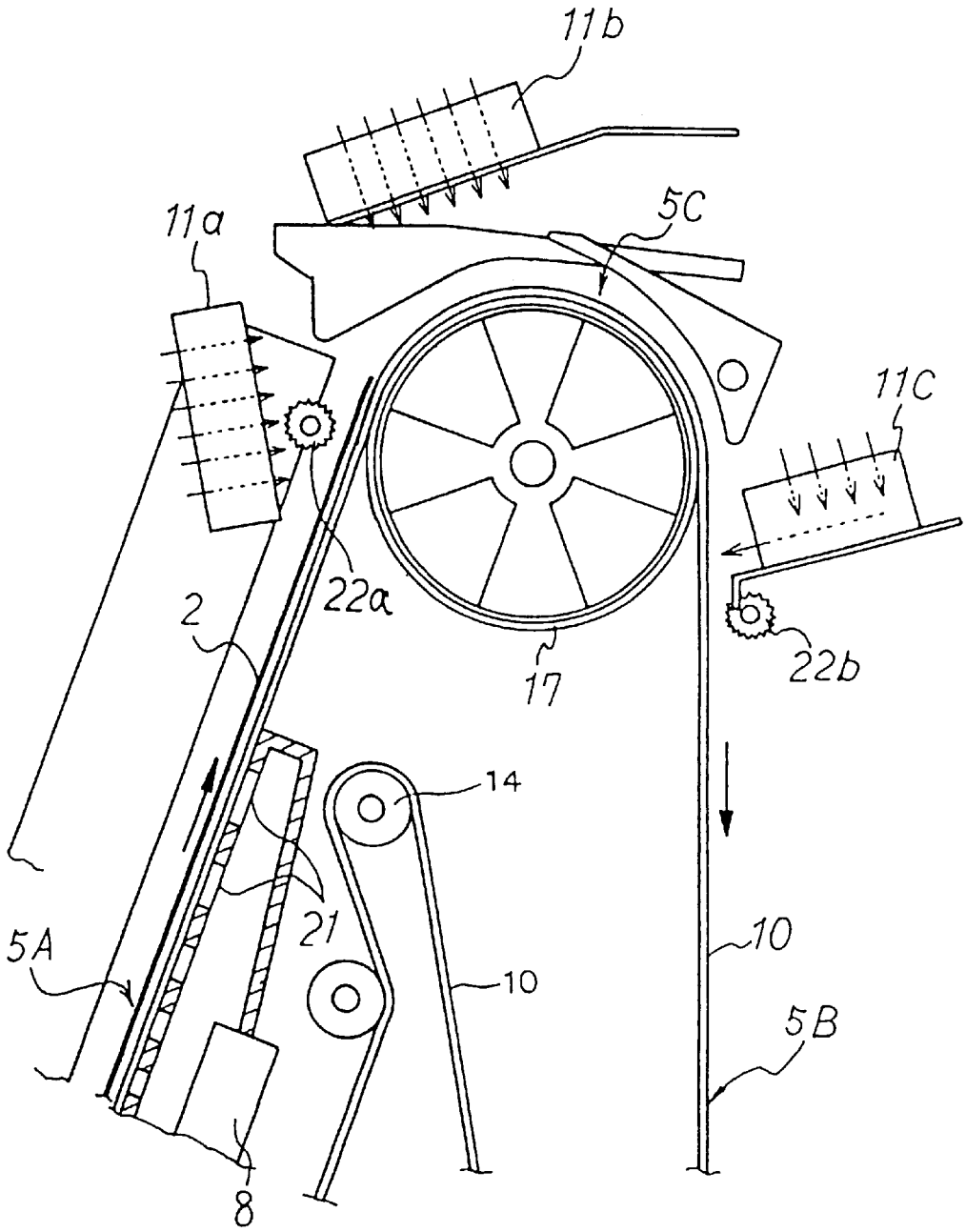
FIG. 3 is a side view showing a vicinity of a curved portion of a conveying means.
Figure 4:
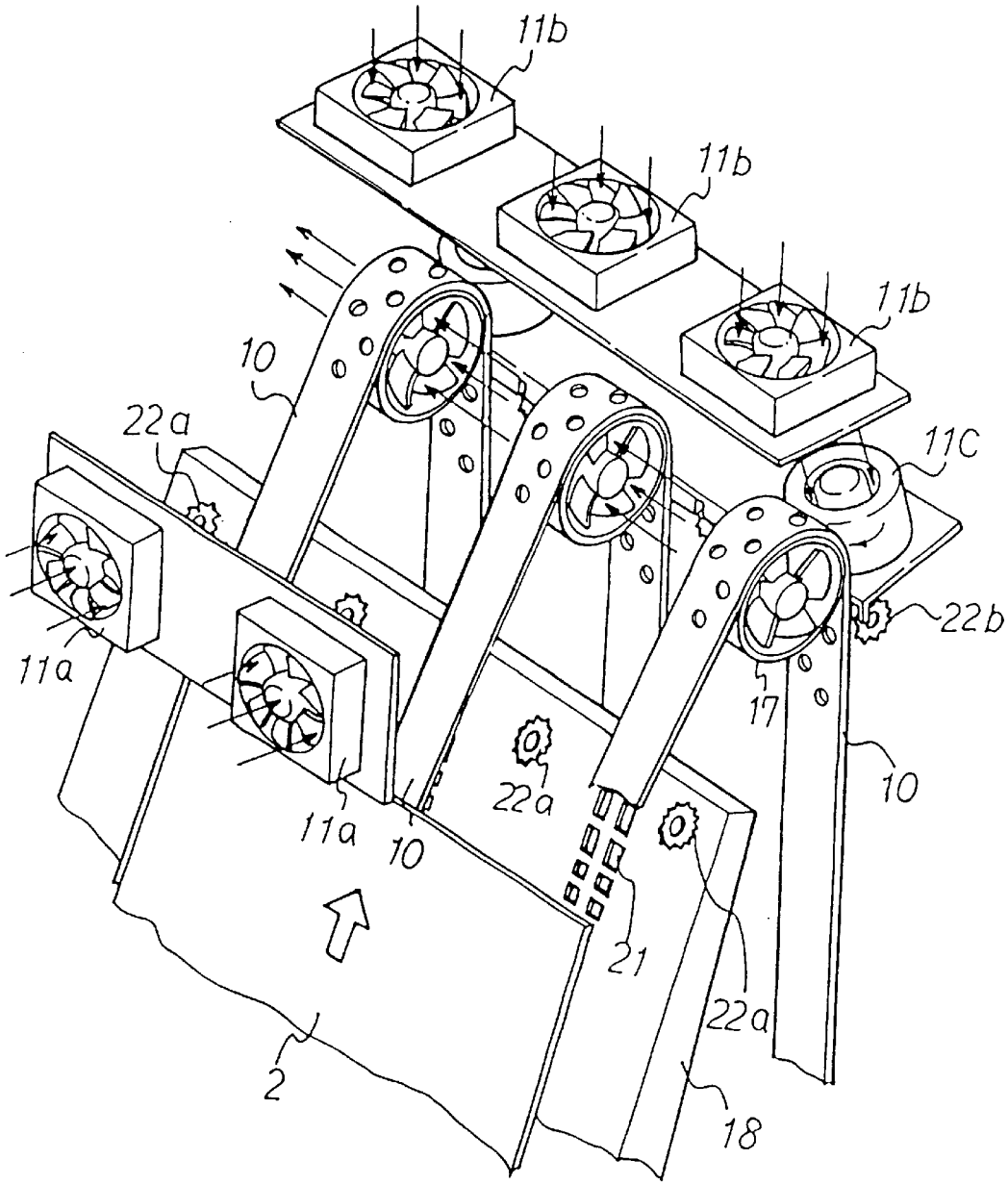
FIG. 4 is an exploded perspective view showing the vicinity of the curved portion of the conveying means.

The first conveying portion 5A is divided into an upstream conveying portion and a downstream conveying portion. In the upstream conveying portion, a perforated conveying belt 9 is extended between belt pulleys 20*a* and 20*b* on both ends, and suction blowers 8 are disposed inside the conveying belt 9, so that the rear face of the sheet 2 is drawn and held during conveying. In the downstream conveying portion, a perforated conveying belt 10 is extended directly from a belt pulley 16 to a belt pulley 17 of the second conveying portion 5B, so that the sheet 2 can be smoothly delivered from the first conveying portion 5A to the second conveying portion 5B. Also, inside the downstream conveying portion of the first conveying portion 5A and the second conveying portion 5B, the suction blowers 8 are disposed in the same manner as aforementioned. On a rear side of the upper proximal end of the downstream conveying portion, there is provided a U-turn roller 14 for returning the perforated conveying belt 10 from the second conveying portion 5B to the first conveying portion 5A. In the curved portion 5C disposed is an air blower 11 which blows an air current to press the sheet 2 against a curved conveying face. Especially, for a vicinity structure of the curved portion 5C, as shown in FIGS. 3 and 4, around the upper end of the first conveying portion 5A, a box-like duct 18 is disposed on rear sides of the perforated conveying belts 10. Also, a pressure inside the duct 18 is reduced by the suction blowers 8. Further, the duct 18 has openings 21 which open toward the conveying belts 10 to draw and hold the sheet 2. The duct 18 is tapered in such a manner that the duct 18 becomes thinner, that is, the cross-sectional area thereof becomes smaller as the duct 18 is apart from the suction blowers 8. Also, the openings 21 are small near the suction blowers 8, and gradually become larger apart from the suction blowers 8. A suction retention force by means of the suction blowers 8 can be uniformed, while a sheet holding force is controlled.

Also, in the curved portion 5C on the upper end of the second conveying portion 5B, three large-diameter belt pulleys 17 are disposed, around which the perforated conveying belts 10 from the first conveying portion 5A are extended to be run and operated. Also, three air blowers 11*a*, 11*b* and 11*c* are directed toward a conveying face of the curved portion 5C to blow an air current thereto. By means of a pressure of the air current, the sheet 2 is bent or deformed along the curved configuration of the conveying face. By running the conveying belts 10, the sheet 2 is conveyed via the curved portion 5C downward to the indexer 6 by the second conveying portion 5B. Further, in the embodiment, in the vicinity of the air blowers 11*a* and 11*c* on the front and rear side of the curved portion 5C, a plurality of small press rollers 22*a* and 22*b* with saw teeth formed on peripheral faces are arranged in a transverse direction. In the curved portion 5C for curving the sheet 2 at an acute angle in the conveying direction, the press rollers 22*a* and 22*b* press and prevent the tip end of the sheet 2 from bouncing up. The press rollers 22*a* and 22*b* are effectively operative, especially, for conveying a thick sheet. Additionally, the press rollers 22*a* and 22*b* can be selectively operated in accordance with the types of sheets to be conveyed.

Also, as shown in FIG. 1, on the opposite side of the image forming device 1, the sheet distribution device S is cascade-connected to plural units of a slave machine S1 which has the same constitution as the body of the sheet distribution device S. The number of the distribution bins 4 can thus be increased. When the slave machine S1 is connected, a third conveying portion 5D (junction conveying portion) for conveying the sheet 2 to the slave machine S1 is detachably attached to the upper portion. In the embodiment, as shown in FIGS. 1 and 2, a space 19 for storing the third conveying portion 5D is horizontally formed in the upper portion of the sheet distribution device S. The first conveying portion 5A of the slave machine S1 can be inserted and fixed in the space 19 so that the plural sheet distribution devices S can be connected.

Also, the image forming device 1 is provided with a discharged sheet base 13 for accumulating the discharged sheets 2 when they are not sorted. Also, on an outer wall face of the sheet distribution device S attached is an outside electromotive stapler 15.

In the sheet distribution device S, as shown in FIG. 2, in the vicinity of the receiving end of the top distribution bin 4 and the receiving end of the lowermost distribution bin 4, a light emission sensor 23*a* and a light receiving sensor 23*b* are provided. The light emission sensor 23*a* detects that the sheet 2 fed from the indexer 6 is stored in the distribution bin 4, while the light receiving sensor 23*b* detects that a bunch of sheets are pushed out to a position in which the bunch can be stapled.

Figure 5:
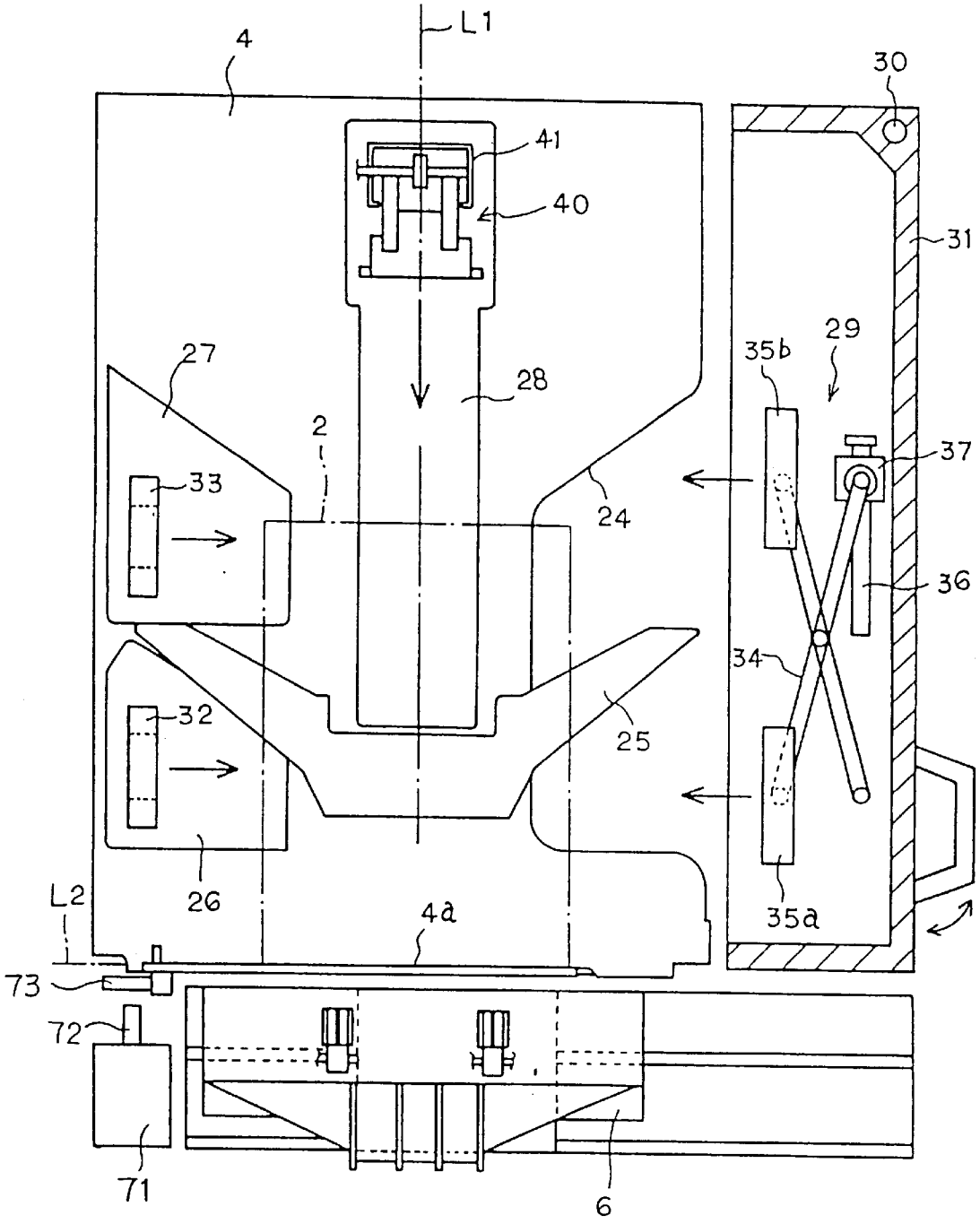
FIG. 5 is a plan view of a distribution bin in the sheet distribution device.

As shown in FIG. 5, the distribution bin 4 is a rectangular flat plate, and has in one side a large notched portion 24 via which the sheet 2 can be easily taken out. Also, on a top face of the distribution bin 4 disposed is a substantially V-shaped sheet support plate 25 which is protruded to a middle portion of the notched portion 24 to prevent the sheet 2 from hanging down. In the distribution bin 4, two large openings 26 and 27 are formed on the opposite side of the notched portion 24, and further an elongated guide hole 28 is formed in a back to forth direction in the middle portion. Also, matching members are disposed in the notched portion 24, the openings 26, 27 and the guide hole 28, respectively, so that the sheet 2 is matched with two reference positions L1 and L2. A first matching member 29 provided in the notched portion 24 is housed inside a sheet taking-out door 31 which can be opened/closed about an axis 30. Together with a pair of second matching members 32 and 33 provided in the openings 26 and 27 on the opposite side, the first matching member 29 pushes opposite side edges of the sheet 2 to transversely move the sheet 2. The sheet 2 is thus matched with the middle reference position L1.

Especially, the first matching member 29 housed in the sheet taking-out door 31 is operated by a linkage 34. When the device is inoperative or when the sheet taking-out door 31 is opened/closed, the linkage 34 is contracted and housed in the door 31. On the other hand, when the sheet 2 is matched, the linkage 34 is expanded. Then, one side edge of the sheet 2 is pushed out by a pair of vertically long matching plates 35*a* and 35*b* which are mounted on tip ends of the linkage 34. The first matching member 29 is operated by a screw shaft 36 rotated by a motor (not shown) and a nut 37 which slides on the shaft 36. The operating portion is provided in the lower portion of the sheet taking-out door 31.

Figure 6:
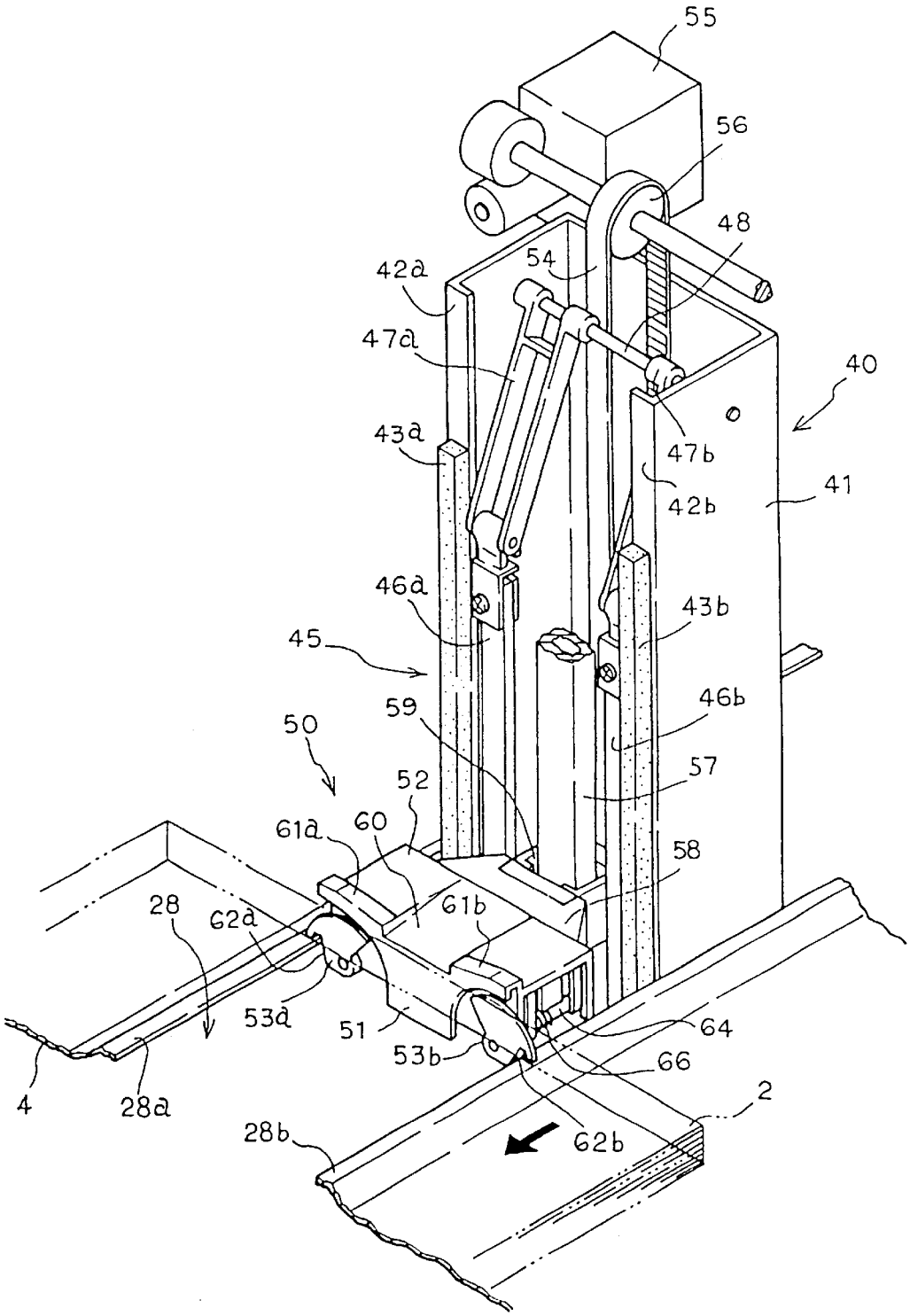
FIG. 6 is an enlarged perspective view showing a main portion of the invention.

A third matching member 40 is provided in the middle guide hole 28 for pushing the discharge tip end of the sheet 2 to match the sheet 2 with the reference position L2 along a vertical wall 4*a* which is built on the sheet receiving end of the distribution bin 4. As shown in FIGS. 5 and 6, the third matching member 40 is constituted of a guide rail 41 having a U-shaped cross section which is vertically passed through the distribution bin 4. As abutment faces relative to the printed sheet 2 to be matched, the guide rail 41 has on its edges of an opening flat vertical faces 42*a* and 42*b*. The vertical faces 42*a* and 42*b* are opposed to each other on the sheet receiving end of the distribution bin 4. Elastic members 43*a* and 43*b* formed of sponge or the like are placed along lengths of the vertical faces 42*a* and 42*b*.

Also in the embodiment, a string-like stopper member 45 is extended vertically in front of the third matching member 40. The stopper member 45 elastically thrusts at the discharge tip end of the printed sheet 2 ejected from the indexer 6 toward the distribution bin 4 to moderately stop the sheet 2. For this purpose, used are two bands 46*a* and 46*b* formed of rubber which provides a larger damper effect than sponge. As shown in FIG. 6, upper ends of the rubber bands 46*a* and 46*b* are rotatably attached to tip ends of levers 47*a* and 47*b*. When the sheet 2 thrusts at the rubber bands 46*a* and 46*b* with its discharge tip end, the rubber bands can be largely deflected. Rear ends of the levers 47*a* and 47*b* are supported by a shaft 48 which is extended in the upper end of the guide rail 41. By rotating the shaft 48 with a drive means (not shown), the levers 47*a* and 47*b* are rotated back and forth. Therefore, as shown in FIG. 6, the rubber bands 46*a* and 46*b* can be positioned in front of or behind the elastic members 43*a* and 43*b*. Additionally, lower ends (not shown) of the rubber bands 46*a* and 46*b* are rotatably attached to levers which have the same constitutions as aforementioned.

In the embodiment, a sheet bunch pushing member 50 is provided in front of the guide rail 41. After all the sheets 2 are delivered and distributed by the indexer 6, to staple the sheets as a post-processing, the sheet bunch pushing member 50 is moved vertically along the guide rail 41 to push out a bunch of sheets accumulated on the distribution bin 4 to an elevating/lowering passage of the indexer 6. Additionally, as the post-processing besides the stapling the sheets 2 are punched (not shown). Also in this case, the sheets 2 are moved to a predetermined direction by using a sheet moving member in the same manner as aforementioned.

Figure 7:
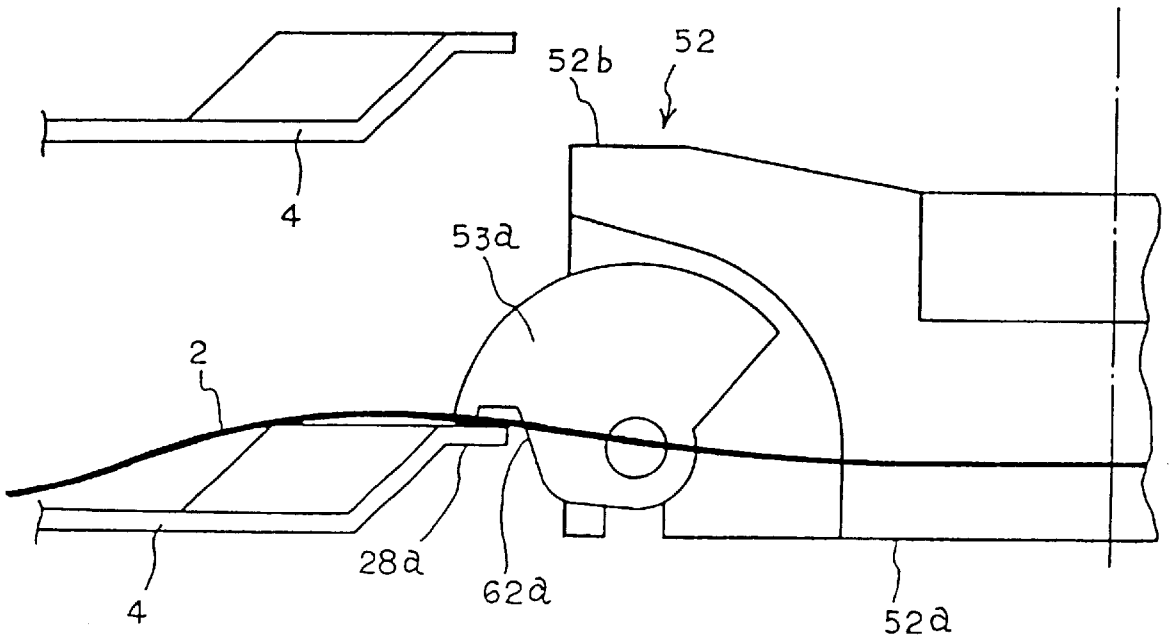
FIG. 7 is an enlarged view showing a rising of a side edge of a guide hole formed in the distribution bin.

As shown in FIGS. 6 and 7, the sheet bunch pushing member 50 is constituted of a base portion 58 provided in the guide rail 41, a substantially rectangular parallelepiped body 52 positioned before the base portion 58 and having a vertical pushing face 51 formed thereon, and substantially fan-shaped engaging members 53*a* and 53*b* provided on opposite sides of the pushing face 51. A rear end of the base portion 58 is fixed to a belt 54 provided in the guide rail 41. The belt 54 is extended around a pulley 56 which is provided in the vicinity of a top or lowermost distribution bin 4. By rotating the belt 54 with a motor 55, the sheet bunch pushing member 50 is lowered in the guide hole 28 to each distribution bin 4. Also, in the base portion 58 formed is a rectangular hollow portion 59 which is engaged with a vertically long guide rod 57.

On a middle portion of a top face of the body 52 formed is a slant face 60 which is directed downward toward its front side. Also, above the engaging members 53*a* and 53*b* formed are hood portions 61*a* and 61*b* which are slanted inwardly. Additionally, the engaging members 53*a* and 53*b* are provided with recesses 62*a* and 62*b* which are engaged with opposite side edges 28*a* and 28*b* of the guide hole 28. When the side edges 28*a* and 28*b* of the guide hole 28 slide along the recesses 62*a* and 62*b* in a restricted manner, the sheet bunch pushing member 50 can be allowed to advance or retreat along the guide hole 28. Also, as shown in FIGS. 6 and 7, the side edges 28*a* and 28*b* of the guide hole 28 are raised obliquely along peripheral edges to form faces higher than a plane of the distribution bin 4, thereby inhibiting the accumulated sheets 2 from hanging down in the guide hole 28. Since the side edges 28*a* and 28*b* are thus raised, the sheet 2 is forced to be lifted up. Then, the sheet 2 is given a waist, and prevented from hanging down. The distribution bin 4 below the sheet 2 is not adversely affected. Also, when the bunch of sheets are pushed out, a trouble caused by the hanging sheet can be avoided beforehand. Further, a lower face 52*a* of the body 52 of the sheet bunch pushing member 50 is positioned lower than the side edges 28*a* and 28*b* of the guide hole 28, preferably in the same position as the plane of the distribution bin 4. Therefore, even if the sheet slightly hangs down, the sheet can be securely pushed out. Further in the embodiment, a top face 52*b* of the body 52 has substantially the same height as a lower face of the distribution bin 4 above. Therefore, when the sheet bunch pushing member 50 is moved, no clearance is made between the top face 52*b* of the body 52 and the lower face of the distribution bin 4 above. No sheet 2 is left not pushed.

Figure 8:
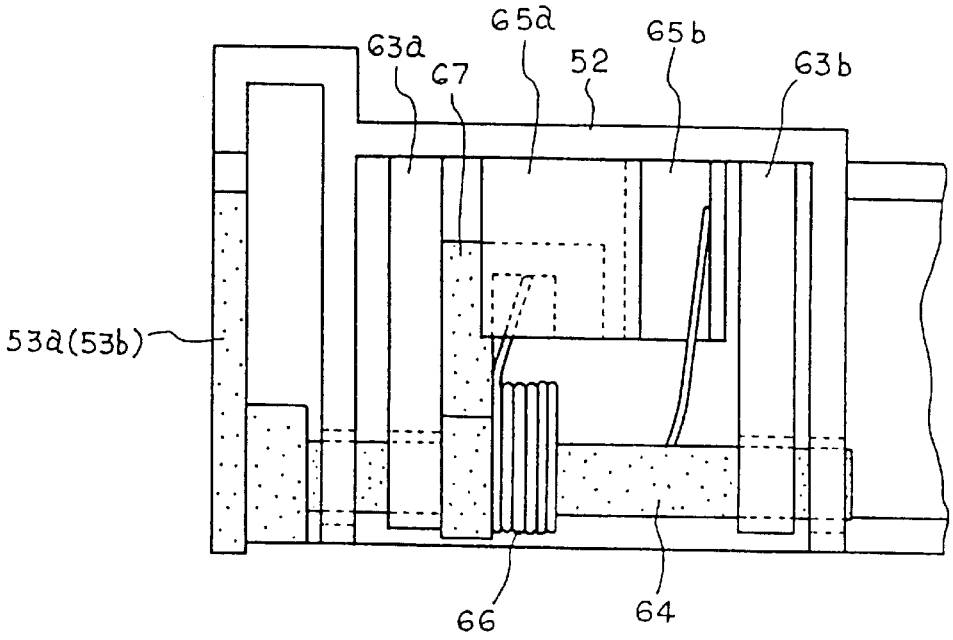
FIG. 8 is a side view showing an attachment structure of an engaging member.
Figure 10:
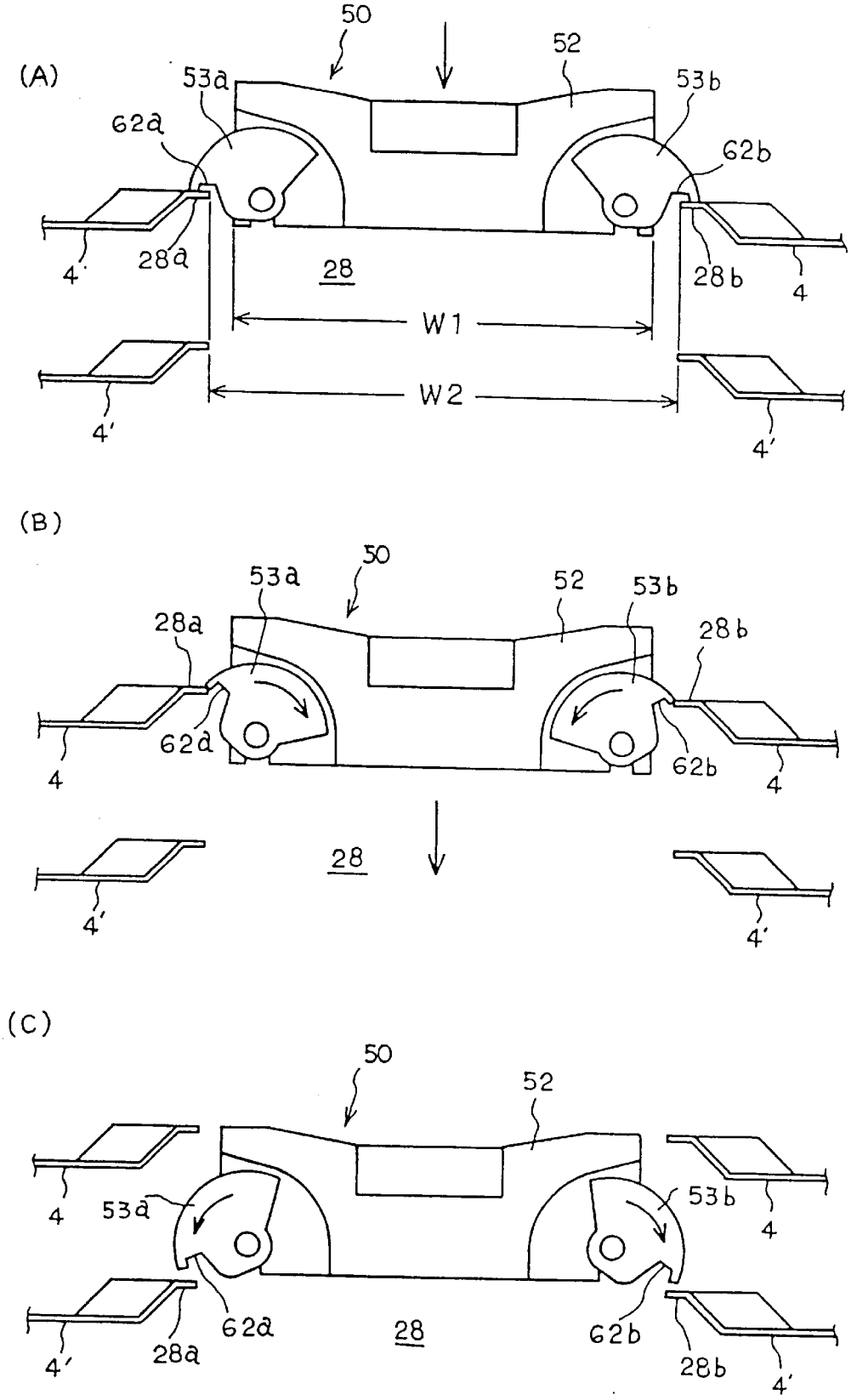
FIGS. 10A to 10C are explanatory views showing a movement of the engaging member when the sheet bunch pushing member moves.

As shown in FIGS. 6 and 8, pushing faces of the engaging members 53*a* and 53*b* are positioned on the same plane as the pushing face 51 of the body 52 to push the bunch of sheets together with the pushing face 51. On rear faces of the engaging members 53*a* and 53*b* built are axial pins 64 whose front and rear ends are rotatably supported by support legs 63*a* and 63*b* of the body 52. Coil springs 66 are wound around the axial pins 64. Opposite ends of each coil spring 66 are fixed to two walls 65*a* and 65*b* of the body 52. The coil springs 66 usually apply a biasing force to the engaging members 53*a* and 53*b* in an outward rotating direction. Also, from each axial pin 64 protruded is a stopper piece 67. By placing the stopper piece 67 in contact with one wall 65*a,* the outward rotation is restricted. A predetermined attitude is thus secured. Additionally, as shown in FIG. 10A, a width W1 of the body 52 is narrower than an opening width W2 of the guide hole 28 in a right-to-left direction. The guide rail 41 is operated by a drive mechanism (not shown) to advance or retreat horizontally along the guide hole 28 while keeping its perpendicularly raised condition. Following the horizontal movement of the guide rail 41, the sheet bunch pushing member 50 moves horizontally. Thereby, the bunch of sheets are pushed out.

Figure 9:
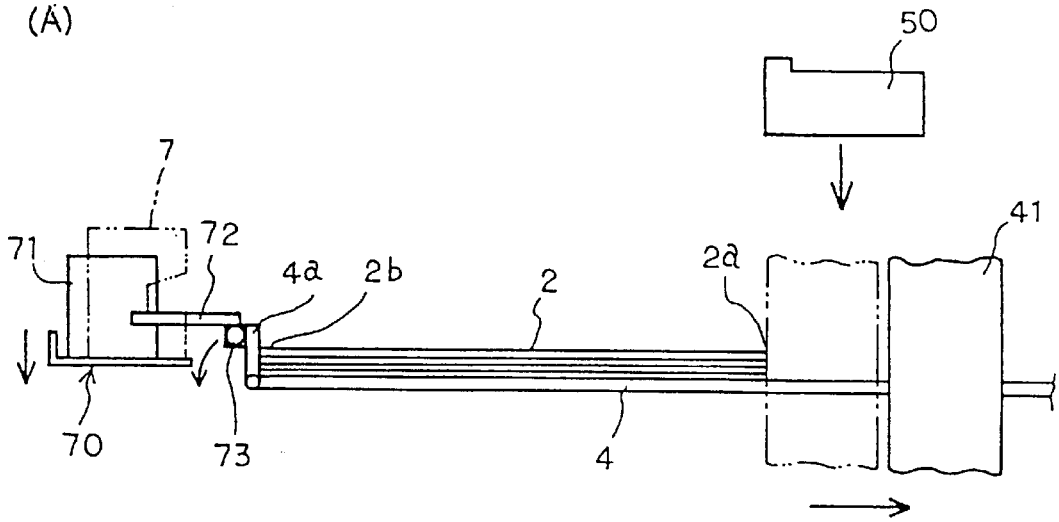
FIGS. 9A and 9B are diagrammatic views showing an operation of a sheet bunch pushing member.
Figure 9:
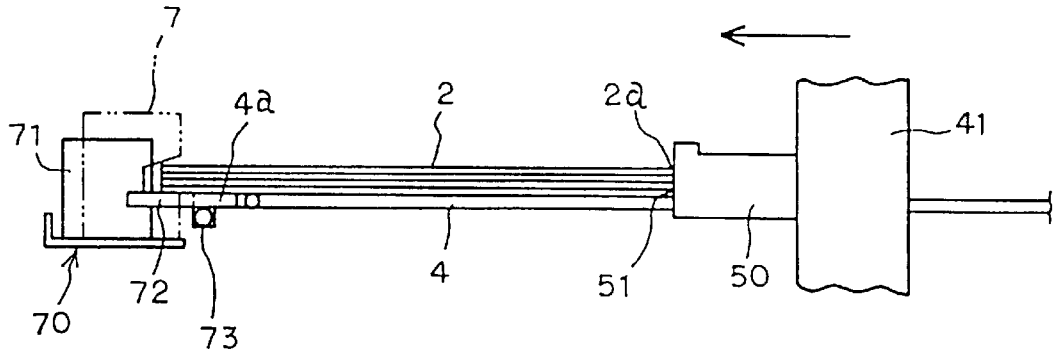

Operation of the sheet bunch pushing member 50 constituted as aforementioned will be described with reference to FIGS. 6, 9A, 9B and 10A to 10C. When the guide rail 41 functions as a matching member for matching the printed sheet 2, the sheet bunch pushing member 50 is lowered or elevated along the guide rail 41 apart from the guide hole 28 to a position in which the matching operation is not inhibited. Then, as shown in FIG. 9A, discharge tip ends 2*a* of the sheets 2 are pushed by the guide rail 41. Receiving ends 2*b* of the sheets 2 are pressed against the vertical wall 4*a* of the distribution bin 4 to be matched. Subsequently, the sheet bunch pushing member 50 is moved along the guide rail 41 to a predetermined height. Additionally, a staple unit 70 is moved to a position as high as the sheet bunch pushing member 50. Then, a lever 72 of a vertical wall opening/closing means 71 disposed on one side of the staple unit 70 is extended to be caught by a handle 73 provided on the vertical wall 4*a*. In the condition, the staple unit 70 is slightly lowered to push down the vertical wall 4*a* toward the elevating/lowering passage.

In this condition, when the guide rail 41 starts moving from the position shown in FIG. 6 along the guide hole 28 toward the receiving end, the sheet bunch pushing member 50 slides integrally with the guide rail 41 with the recesses 62*a* and 62*b* of the engaging members 53*a* and 53*b* engaged with the side edges 28*a* and 28*b* of the guide hole 28. Then, as shown in FIG. 9B, the pushing face 51 of the sheet bunch pushing member 50 pushes the discharge tip ends 2*a* of the bunch of sheets. The bunch of sheets are pushed out toward the stapler 7 and the elevating/lowering passage as they are. The receiving ends 2*b* of the sheets are inserted in the stapler 7 and bundled.

After the pushing operation is finished, the sheet bunch pushing member 50 retreats to a matching position shown in FIG. 9A without retreating to a position in which the sheet bunch pushing member 50 is completely detached from the guide hole 28. In the condition, the sheet bunch pushing member 50 is lowered to the next lower distribution bin 4. FIGS. 10A to 10C show that the sheet bunch pushing member 50 which has finished the pushing operation moves from the distribution bin 4 to the next lower distribution bin 4'. FIG. 10A shows that the engaging members 53*a* and 53*b* of the sheet bunch pushing member 50 are engaged with the side edges 28*a* and 28*b* of the guide hole 28. When the sheet bunch pushing member 50 is slightly lowered from the condition along the guide rail 41, the engaging members 53*a* and 53*b* are rotated inwardly against the elastic forces of the coil springs 66. As shown in FIG. 10B, the recesses 62*a* and 62*b* are disengaged from the side edges 28*a* and 28*b*. The disengaged engaging members 53*a* and 53*b* retreat into the guide hole 28. Together with the engaging members 53*a* and 53*b,* the body 52 is disengaged from the guide hole 28 to reach the lower distribution bin 4'. As shown in FIG. 10C, before arriving on the lower distribution bin 4', the engaging members 53*a* and 53*b* are rotated outwardly by the restored elasticity of the coil springs 66 to restore original attitudes. Therefore, the recesses 62*a* and 62*b* are again engaged with the side edges 28*a* and 28*b* of the guide hole 28. From the position, the operation can shift to the sheet bunch pushing operation.

As aforementioned, in the embodiment by successively lowering the sheet bunch pushing member 50, the bunch of sheets matched on the distribution bin 4 are pushed out. In this case, the sheet bunch pushing member 50 is quickly moved, thereby shifting to the next pushing operation. Additionally, in the above description, the post-processing is performed by the stapler 7. However, also when the post-processing is performed by a punching device, the sheets are moved and the sheet moving member is also moved in a series of operations in the same manner as aforementioned. Also, in the embodiment, by lowering the sheet bunch pushing member 50 along the guide rail 41, the engaging members 53*a* and 53*b* are disengaged from the side edges 28*a* and 28*b* of the guide hole 28. Alternatively, when the sheet bunch pushing member 50 is moved, by using a solenoid or another drive means, the engaging members 53*a* and 53*b* are rotated or slid inwardly. Then, the engagement can be forced to be released. Further in the embodiment, the sheet bunch pushing member 50 is moved relative to the vertically arranged and fixed distribution bins 4. Conversely, the vertical movement of the sheet bunch pushing member 50 is restrained, and the distribution bin 4 may be moved. Also, in the embodiment the bunch of sheets accumulated on the distribution bin 4 are pushed out by the sheet bunch pushing member 50. The pushing mechanism is not restricted to the aforementioned as long as it can move a sheet or a bunch of sheets. Further, when the distribution bins 4 are arranged horizontally, not vertically, the sheet moving mechanism is moved in a substantially horizontal direction which extends through image formed faces of sheets accumulated transversely on the distribution bins 4.

Figure 11:
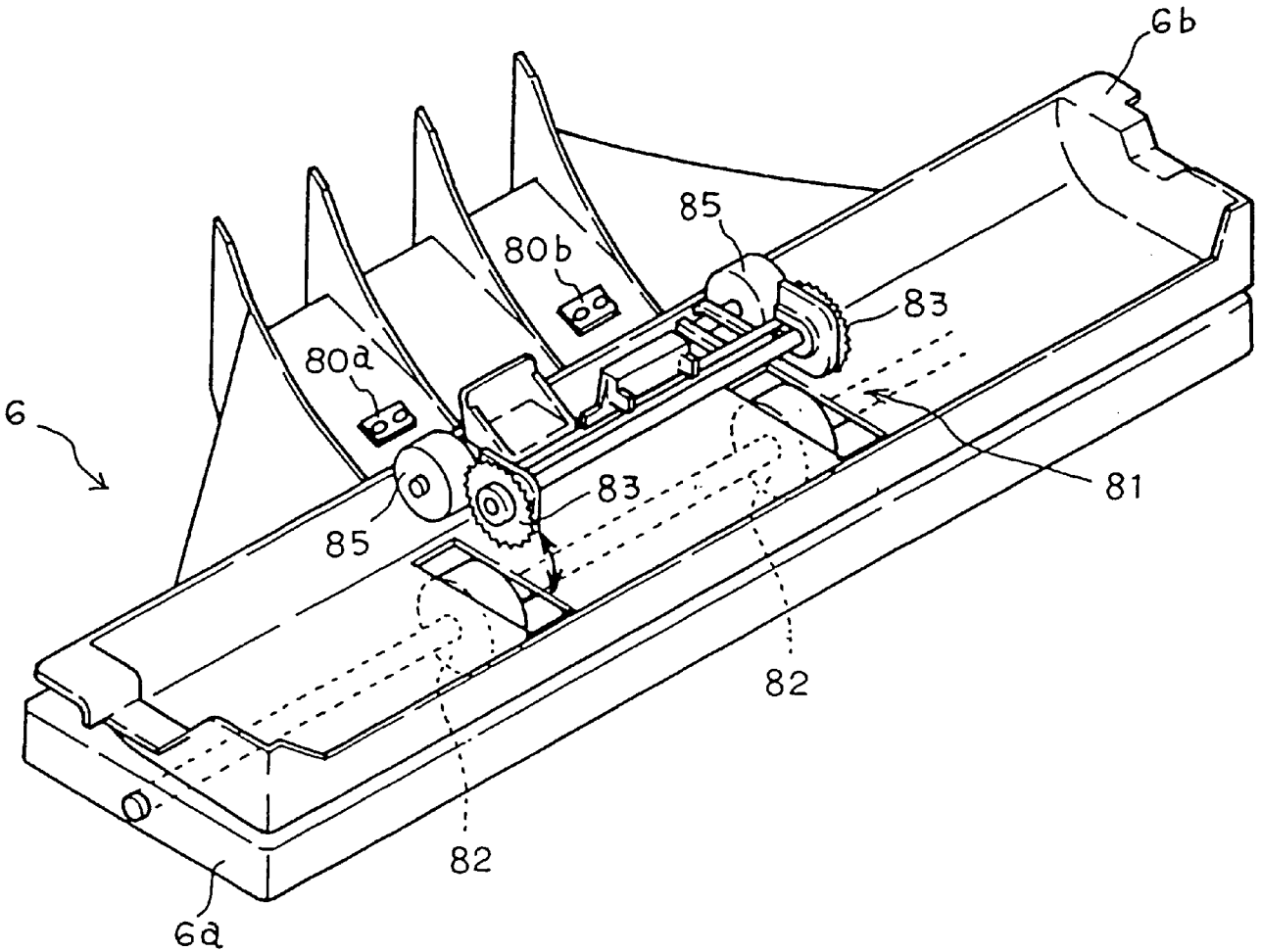
FIG. 11 is a perspective view showing an embodiment of a sheet inclination correction device mounted on an indexer.
Figure 12:
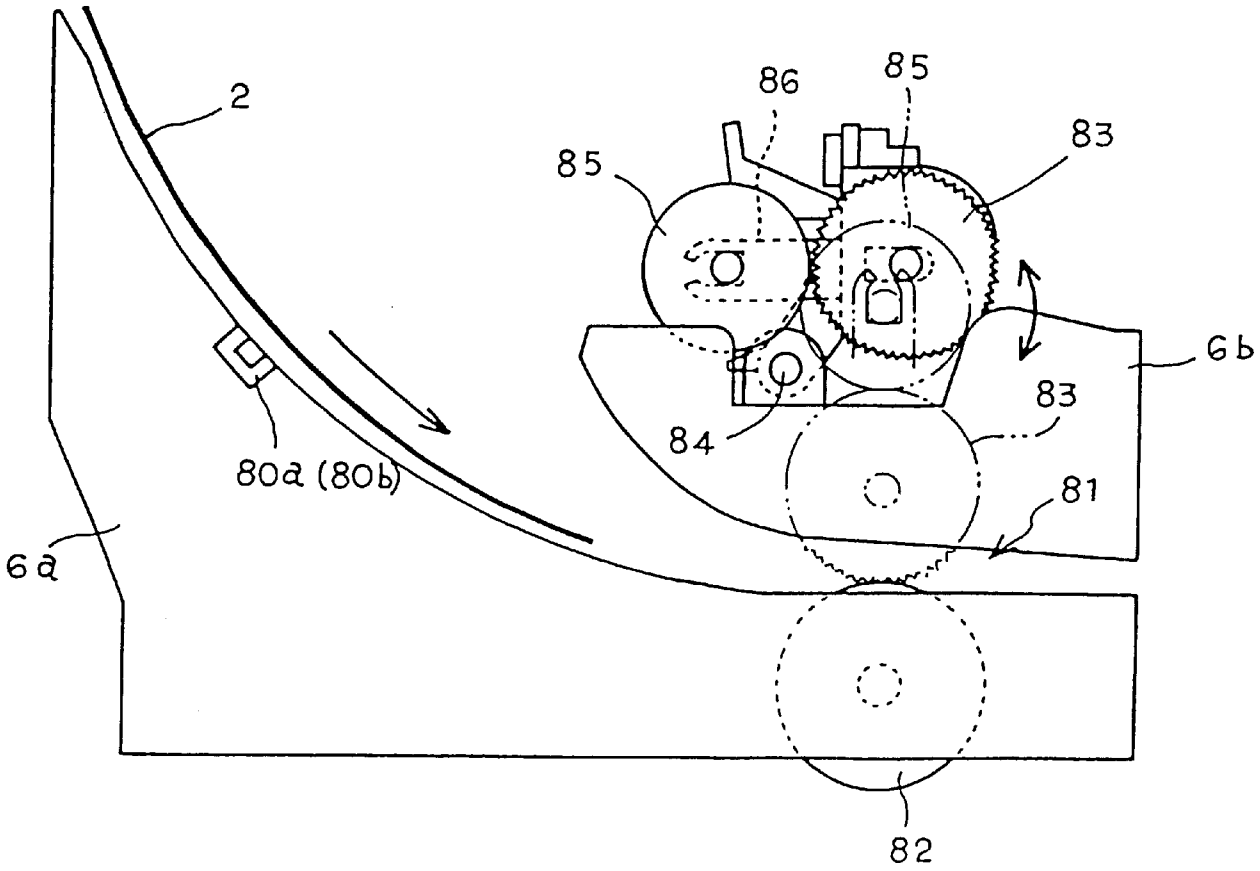
FIG. 12 is an enlarged side view of the sheet inclination correction device of FIG. 11.

FIGS. 11 and 12 show sheet rear-end detecting sensors 80*a* and 80*b* and a correction roller 81 which are mounted on the indexer 6. A pair of the rear-end detecting sensors 80*a* and 80*b* are disposed in a right-to-left direction on a lower cover 6*a* of the indexer 6. Right and left rear ends of the sheet 2 which slides down along a slant face of the lower cover 6*a* are detected, respectively. From a difference in detection time, a bent degree of the sheet 2 is calculated. If the difference time exceeds a predetermined allowable time, a motor, a solenoid or another drive means (not shown) operates the correction roller 81 which is positioned in front of the drive means. The correction roller 81 is constituted of slide rollers 82 provided on the lower cover 6*a* of the indexer 6 and saw teeth-like rollers 83 which are provided above the slide rollers 82 and on an upper cover 6*b* of the indexer 6. The saw teeth-like rollers 83 can be rotated vertically about a rotation axis 84. Usually, the rollers 83 are positioned apart from the slide rollers 82. In this case, the sheet 2 naturally falls from the indexer 6 to the distribution bin 4. When the difference in time between the rear-end detecting sensors 80*a* and 80*b* exceeds the allowance, the saw teeth-like rollers 83 are rotated downward to abut on the slide rollers 82. The next sheet 2 is held between the rollers 82 and 83, and forced to be fed to the distribution bin 4. The sheet 2 is prevented as much as possible from being bent when accumulated on the distribution bin 4, so that the sheet matching can be smoothly performed. Additionally, clean rollers 85 having adhesive surfaces slidably abut on the saw teeth-like rollers 83 in such a manner that paper dust of the sheet 2 is removed from the saw teeth. Additionally, the clean rollers 85 are detachably attached to a support frame 86. In the embodiment, when the bent degree of the sheet 2 is detected, a guide may be displayed on an operation panel in such a manner that an operator manually operates the correction roller 81.

According to the sheet distribution device of the invention, after the sheets are pushed out by the sheet pushing member from one distribution bin to the post-processing device, the sheets on the next distribution bin are to be pushed out. In this case, without retreating the sheet pushing member to a position in which the sheet pushing member is detached from the guide portion of the distribution bin, the engaging portion of the sheet pushing member is disengaged from the guide portion within the guide portion. The sheet pushing member can be elevated or lowered to the next distribution bin. The horizontal movement distance of the sheet pushing member can thus be shortened. Therefore, an operation time required for moving the sheets accumulated on multiple trays of distribution bins can be largely reduced.

What is claimed is:

1. A sheet distribution device which is provided with:

a plurality of distribution bins in which sheets discharged from an image forming device are distributed and stored;

a post-processing means for post-processing the sheets stored in said each distribution bin; and a sheet pushing member provided along said plurality of distribution bins and being able to be operated to advance or retreat along said each distribution bin for pushing out toward said post-processing device the sheets stored in said each distribution bin, a moving means for elevatably moving at least one of said sheet pushing member and said each distributing bin, said each distribution bin being provided with a guide portion which allows said sheet pushing member to advance or retreat along said each distribution bin, said sheet pushing member being provided with an engaging portion which abuts on said guide portion of said distribution bin, and wherein said engaging portion of said sheet pushing member can be moved to a direction in which engagement of said guide portion of said distribution bin is released.

2. The sheet distribution device according to claim 1, wherein said engaging portion of said sheet pushing member is disposed rotatable about an axial line parallel with a sheet pushing direction, and constituted of a member biased in a direction to abut on an upper portion of said guide portion of the distribution bin.

3. The sheet distribution device according to claim 1, wherein said guide portion of said distribution bin is formed in a strip in a middle portion of said distribution bin, and there are provided two engaging portions of said sheet pushing member which are opposed to each other on opposite side edges of said guide portion.

4. The sheet distribution device according to claim 2, wherein said guide portion of said distribution bin is formed in a strip in a middle portion of said distribution bin, and there are provided two engaging portions of said sheet pushing member which are opposed to each other on opposite side edges of said guide portion.

5. The sheet distribution device according to claim 1, wherein said post-processing means is a stapler or a punching device.

* * * * *